US007017639B2

(12) United States Patent
McDonald

(10) Patent No.: US 7,017,639 B2
(45) Date of Patent: Mar. 28, 2006

(54) BLADE PROTECTOR FOR TAPE DISPENSER

(75) Inventor: Gerald A. McDonald, Gloucester, MA (US)

(73) Assignee: Henkel Consumer Adhesives, Inc., Avon, OH (US)

( * ) Notice: Subject to any disclaimer, the term of this patent is extended or adjusted under 35 U.S.C. 154(b) by 163 days.

(21) Appl. No.: 10/431,409

(22) Filed: May 7, 2003

(65) Prior Publication Data

US 2004/0089424 A1 May 13, 2004

Related U.S. Application Data

(60) Provisional application No. 60/425,006, filed on Nov. 9, 2002.

(51) Int. Cl.
*B32B 31/00* (2006.01)

(52) U.S. Cl. ..... 156/527; 156/574; 156/577

(58) Field of Classification Search ..... 156/527, 156/523, 574, 576, 577, 579; 225/19, 20, 225/56, 77, 80
See application file for complete search history.

(56) References Cited

U.S. PATENT DOCUMENTS

| | | | | |
|---|---|---|---|---|
| 3,586,587 | A * | 6/1971 | Boyce | 156/527 |
| 3,701,225 | A * | 10/1972 | Perry | 52/71 |
| 3,969,180 | A * | 7/1976 | Ravesloot | 156/523 |
| 4,486,263 | A * | 12/1984 | Monzo Gomez | 156/523 |
| 4,591,407 | A * | 5/1986 | Samuelson | 156/527 |
| 4,818,329 | A | 4/1989 | Tutas et al. | |
| 4,989,769 | A * | 2/1991 | Longworth et al. | 225/20 |
| 5,073,228 | A * | 12/1991 | Lin | 156/523 |
| 5,181,983 | A * | 1/1993 | Sakai | 156/523 |
| 5,363,997 | A | 11/1994 | Harris | |
| 5,393,367 | A | 2/1995 | Yu Chen | |
| 5,456,790 | A | 10/1995 | Yu Chen | |
| 5,468,332 | A * | 11/1995 | Dretzka et al. | 156/527 |
| 5,595,626 | A * | 1/1997 | Yokouchi et al. | 156/577 |
| 5,641,377 | A | 6/1997 | Chung et al. | |
| 5,849,144 | A | 12/1998 | Tang et al. | |
| 5,851,348 | A * | 12/1998 | Muenzer et al. | 156/577 |
| 5,861,080 | A * | 1/1999 | Yang et al. | 156/576 |
| 6,039,102 | A | 3/2000 | Sadrakula et al. | |
| 6,296,033 | B1 | 10/2001 | Clements | |
| 2004/0016509 | A1 * | 1/2004 | Lissoni | 156/523 |

FOREIGN PATENT DOCUMENTS

| | | |
|---|---|---|
| EP | 0 409 532 A1 | 1/1991 |
| FR | 2 060 887 | 6/1971 |
| JP | 06016321 | 1/1994 |
| JP | 09208114 | 8/1997 |

* cited by examiner

*Primary Examiner*—Mark A. Osele
(74) *Attorney, Agent, or Firm*—Connolly Bove Lodge & Hutz LLP

(57) ABSTRACT

A tape dispenser that reduces accidental injury from contact with a sharp blade used to cut and separate tape from the dispenser when affixing the tape to a surface. The cutting blade, fixed at an angle some distance above an opening, or above the edge of a flexible plate, is not exposed unless enough pressure is applied to bend plate far enough to expose blade through and beyond the flexible plate. This invention provides a simpler, safer, more cost effective method of dispensing, affixing and cutting any material in tape form.

9 Claims, 2 Drawing Sheets

BLADE PROTECTOR FOR TAPE DISPENSER

CROSS REFERENCE TO RELATED APPLICATION

This application is based on the disclosure of applicant's U.S. provisional application Ser. No. 60/425,006 filed Nov. 9, 2002, the benefit of which is requested pursuant to 35 U.S.C. § 119(e).

BACKGROUND OF THE INVENTION

This invention relates to the safety and simplicity of devices designed for the dispensing and cutting of transparent, adhesive, masking and strapping tape or any other long, thin flat material stored and dispensed from a roll.

A number of patents have been granted for devices that dispense and cut long, thin material wound on a roll. While some have addressed the problem of accidental injury, none of the previous art adequately simplifies the mechanism to reduce the effort, size or cost of a tape dispenser that provides a level of protection from accidental contact with the cutting blade when device is not in use or when dispensing, cutting, or loading tape.

Several approaches for protecting users of tape dispensers from potential harm from the cutting edge of a tape dispenser appear in these patents. Among those approaches is that described in U.S. Pat. No. 6,296,033 issued Oct. 2, 2001 to Alan Clements which has a removable guard 38 formed from a pliable material which is removably attached to and extends beyond cutting blade 32. The extended length of the guard 38 beyond the outer edge of cutting blade 32 limits impact of the blade on objects and the user. (See FIG. 3 and column 3, lines 28–40). The Clements patent also discloses use of a less pliable guard which is scored along a bendline to form a resilient hinge (See column 3, lines 40–44). Movement of the guard 38 out of its guarded position over the serrated blade 32 is achieved by the tape as it is drawn off the tape roll and toward contact with the blade. The tape pulls the shield 38 away from the blade to facilitate the latter's penetration and cutting of the tape. (See FIG. 4 and column 3, lines 60, et seq.).

Another approach to guarding the cutting edge of a tape dispenser from unwanted harm to the user is use of a pivoting shield of the type disclosed in U.S. Pat. Nos. 5,456,790 and 5,393,367 issued to Chen, et al. These patents disclose a rigid pivoted shield 20 that is normally biased into a protective position over the cutting blade 30. The shield 20 is pivoted out of its protective position as the tape dispenser is tilted to dispense tape, thereby allowing cutting engagement of the blade 33 with the tape (See FIGS. 5–6 and column 4, lines 42–47 of the '790 patent).

Other patents approach the problem of sharp cutting blades with mechanisms that retract the blade until it is needed to cut the tape. In U.S. Pat. No. 5,641,377 issued Jun. 24, 1997 to Chung, et al., a hand held dispenser employs a mechanism which extends the blade 41 when pressure is applied on a pivoting "wiper" 49 extending from the body of the dispenser (See FIGS. 2–3 and column 4, lines 49, et seq.). A very similar arrangement for a retractable blade is disclosed in U.S. Pat. No. 5,849,144 issued on Dec. 15, 1998 to Tang, et al.

Several different embodiments of blade protection useable in dispensers of sheet material are disclosed in U.S. Pat. No. 6,039,102 issued Mar. 21, 2002 to Sadrakula, et al.

U.S. Pat. No. 4,818,329 issued Apr. 4, 1989 to Tutas, et al. discloses a rigid, spring-biased movable guard 43 over cutting blade 148 mounted on a rotatable shaft 152 which is normally spring biased to cover the blade but can be rotated out of its covering position when the dispenser is rotated into position to dispense tape (See FIGS. 2–3 and column 7, lines 20–49).

SUMMARY OF THE INVENTION

The object of this invention is to provide a simple, cost effective, easy to use device that dispenses and presses and cuts tape onto a surface while protecting a user from accidental contact with the cutting blade when not in use or when cutting tape.

The tape dispenser described herein includes a frame on which a roll of tape is rotatably mounted. Mounted on an extension of the frame is a blade for severing the tape into desired lengths. A flexible shield extends from the frame beyond the edge of the blade a sufficient distance to minimize a user's contact with the blade. The shield also helps to press tape onto the surface of the object being taped.

In one embodiment, the flexible shield contains a slot large enough to permit passage of the blade when the user presses on the frame. That pressure facilitates movement of the blade through the slot into contact with the tape, thereby severing it.

In another embodiment, a member carrying the cutting blade extends from the frame of the tape dispenser parallel to the shield and slightly beyond the leading edge of the shield. When not in use, the cutting blade is suspended just beyond the leading edge of the shield and far enough above the shield to keep it from accidentally injuring the user. When tape is to be applied to an object, downward pressure on the frame causes the shield to flex toward the member carrying the blade, thereby allowing the blade to contact and cut the tape being applied to an object.

DESCRIPTION OF THE PREFERRED EMBODIMENTS

In the following description, like parts are marked throughout the specification and drawing with the same numbers. The drawings are not necessarily to scale and in certain views, parts may be exaggerated for clarity.

Figure 1:
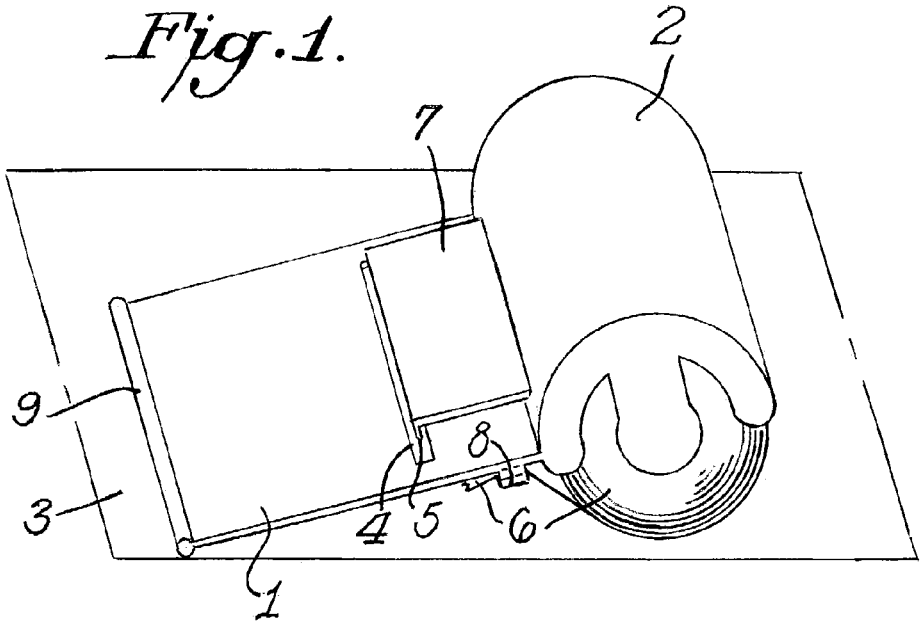
FIG. 1 is a perspective view of a first embodiment of this invention in which the shield extends beyond the blade and showing the alignment of blade and shield prior to cutting of tape.

FIG. 1 shows a tape dispenser 2 that uses a flexible plate 1 for pressing tape onto a surface 3 and to shield cutting blade 5 from user contact. Plate 1 acting as a shield has an opening 4 large enough to permit cutting blade 5 to pass through and cut tape 6 when the shield is flexed by the user's pressure on dispenser 2 beyond that needed to press tape 6 onto a surface 3.

In this embodiment, the forward edge 9 of flexible plate shield 1 is rounded to assist in a smooth application of tape 6 onto the surface 3. Tabs 8 on the underside of shield 1 assist in guiding the tape 6 into position on the underside of plate shield 1. These tabs 8 also hold the loose flap of the tape in place for future applications after the tape is cut by blade 5. (See FIG. 5).

Figure 4:
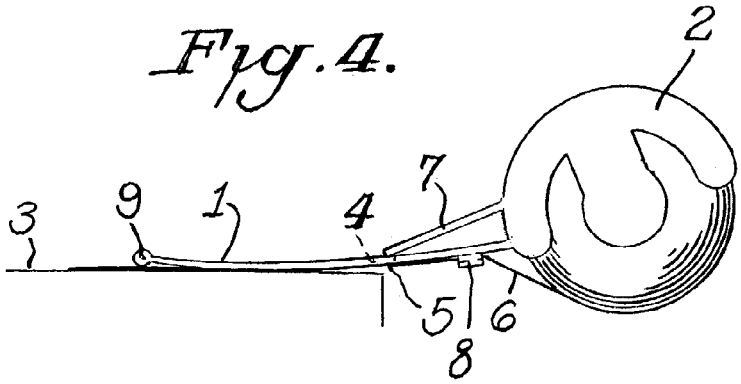
FIG. 4 is a side elevational view of the tape dispenser illustrated in FIG. 1.
Figure 5:
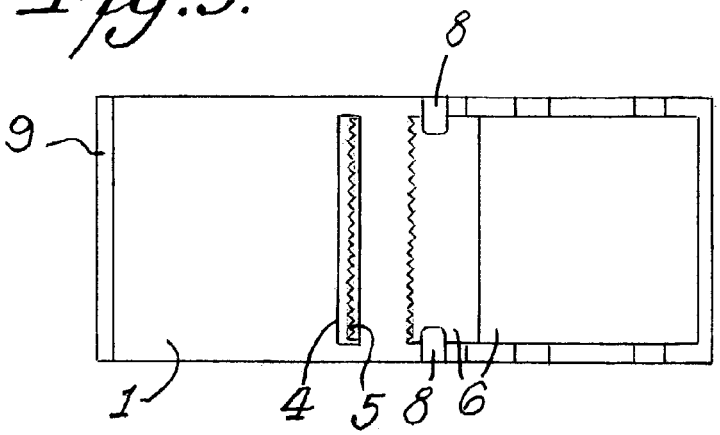
FIG. 5 is a bottom plan view of the tape dispenser shown in FIG. 1.

FIG. 4 depicts a side view of the embodiment shown in FIG. 1, with plate shield 1 flexed or bent to affix tape 6 to a surface 3 with the fixed blade 5 pressed through opening 4 far enough to cut tape 6. Thus, after the user applies the desired amount of tape 6 to the surface 3 of the object being taped and wishes to sever tape 6, he/she pushes forward and downward on the frame of dispenser 2 causing plate shield 1 to flex upward toward blade 5. Blade 5 is mounted on a relatively rigid plate 7 extending from the frame of dispenser 2. The user's forward and downward pressure on dispenser 2 causes the shield 1 to flex upward towards the plate 7 holding blade 5. This movement of plate 1 relative to plate 7 causes the blade 5 to move downward toward the tape 6 on surface 3. Contact of the blade 5 with the tape 6 is facilitated by the opening 4 in shield 1. Blade 5 passes through opening 4 in the shield 1 to sever the tape (See FIG. 4). The loose end of tape 6 after this cutting is retained in position for the next tape application by tabs 8 on the underside of the frame of dispenser 2 as shown in FIG. 5.

Figure 2:
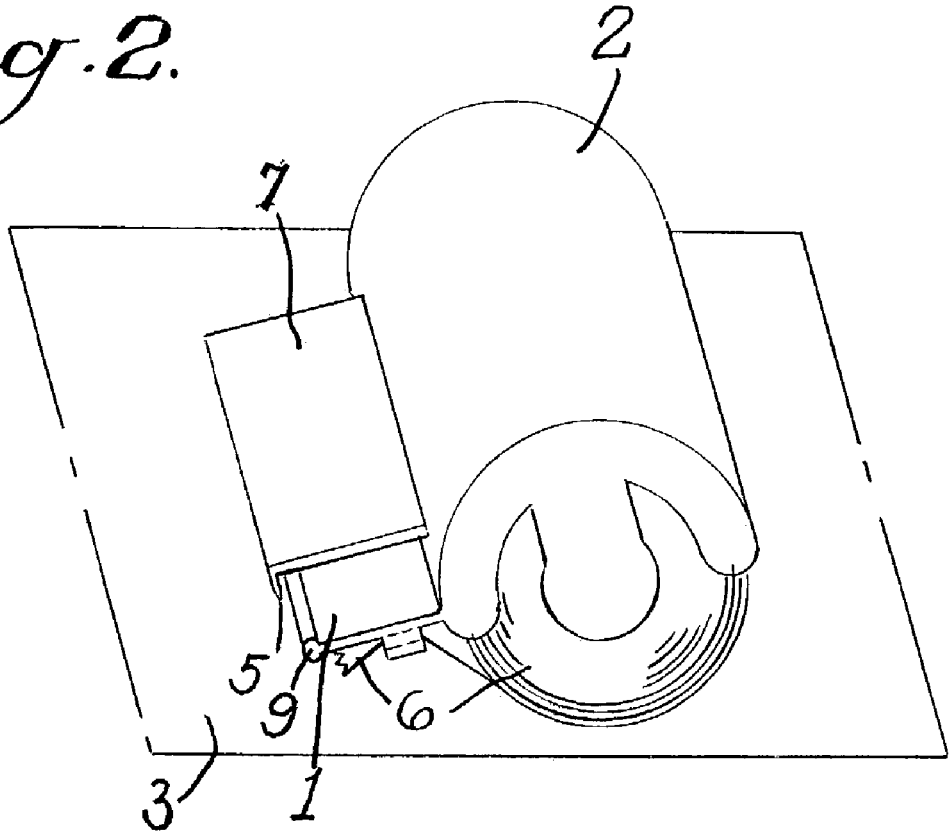
FIG. 2 is a perspective view of a second embodiment of the invention in which the blade extends beyond the shield.

FIG. 2 illustrates another embodiment of tape dispenser 2 that has a flexible plate shield 1 for pressing tape onto a surface 3 and minimizing user injury. The cutting blade 5 is suspended just beyond the front edge of plate 7 and suspended far enough above flexible plate 1 to keep from accidentally injuring a user but close enough to cut tape when a specified pressure beyond that needed to press tape down onto a surface 3 is used.

Figure 3:
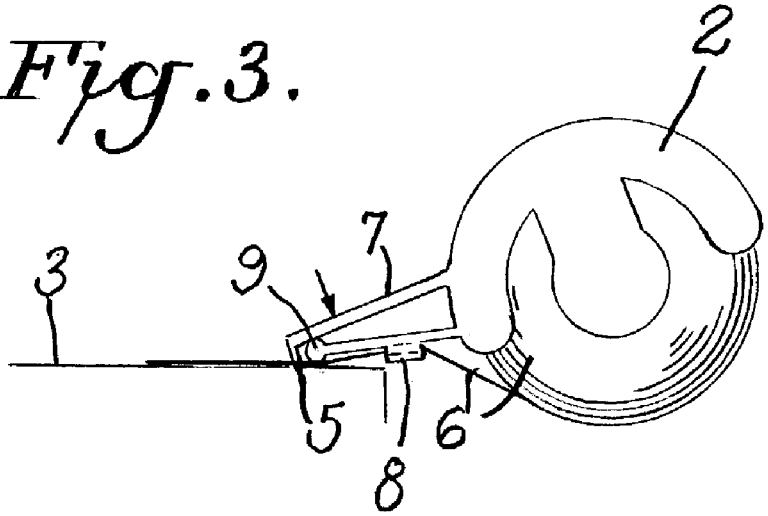
FIG. 3 is a side elevational view of the tape dispenser illustrated in FIG. 2.

In the embodiment shown in FIGS. 2–3, the shield plate 1 is shorter than plate 7 on which cutting blade 5 is mounted. The close proximity, however, of plate 1 adjacent to and underlying plate 7 carrying blade 5 effectively shields blade 5 from unwanted user contact that could cause injury. The leading edge 9 of flexible plate shield 1 is rounded to assist in a smooth application of tape 6 onto surface 3.

In this embodiment, this blade 5 on relatively rigid plate 7 is moved into contact with tape 6 by application of a forward, downward pressure by the user on the frame of tape applicator 2. That pressure causes the protective plate shield 1 to move upwards relative to plate 7 carrying blade 5, thereby allowing blade 5 to contact and cut tape 6 as illustrated in FIG. 3. As with the other embodiment described above, tabs 8 retain the cutoff end of tape 6 in position on the underside of dispenser 2 so that it is available for application to the next object to be taped.

What is claimed is:

1. A tape applicator comprising:

a frame carrying a roll of tape;

a first relatively rigid plate extending from the frame carrying a tape cutting blade thereon;

a second more flexible plate extending from the frame capable of deflection upon application of pressure upon the frame by a user of the tape applicator, the second plate containing an aperature therein of sufficient dimension to allow passage of the cutting blade therethrough when pressure is applied to the frame;

the second plate extending a greater distance from the frame than the first plate and in close alignment therewith whereby user contact with the blade is minimized.

2. The tape applicator of claim 1 wherein the second plate contains at least two tabs on the underside thereof to retain the tape in a position adjacent the frame after it is cut off by the cutting blade.

3. The tape applicator of claim 1 wherein the aperature in the second plate and the cutting blade on the first plate are located at substantially the same distance from the frame.

4. The tape applicator of claim 1 wherein the outer end of the second plate includes a rounded edge to facilitate adherence of tape dispensed from the roll of tape to a surface.

5. A tape applicator comprising:

a frame carrying a roll of tape;

a first, relatively rigid plate extending from the frame including a tape cutting blade associated therewith;

a second, more flexible, plate extending from the frame capable of deflection upon application of pressure on the frame by a user of the tape applicator and having an aperature therein of sufficient dimension and proximity to the blade to allow passage of the cutting blade therethrough when pressure is applied to the frame, thereby limiting contact with the blade by a user of the tape applicator.

6. The tape applicator of claim 5 wherein the second plate deflects in a direction toward the first plate upon application of pressure upon the frame by a user of the tape applicator.

7. The tape applicator of claim 5 wherein at least two tabs adjacent the frame to retain the tape in a position after it is cut off by the cutting blade.

8. The tape applicator of claim 5 wherein a portion of the surface of the second plate extends a greater distance from the frame than the blade associated with the first plate.

9. The tape applicator of claim 5 wherein the second plate includes a rounded surface to facilitate adherence of tape dispensed from the roll of tape onto a surface.

* * * * *